United States Patent [19]

Helm et al.

[11] 4,170,094

[45] Oct. 9, 1979

[54] CLOSURE FOR DOUBLE-WALLED WEBBED STRUCTURES

[75] Inventors: Herbert Helm, Darmstadt; Kurt Kundinger, Griesheim; Karl-Heinz Schanz, Trasisa, Darmstadt, all of Fed. Rep. of Germany

[73] Assignee: Rohm GmbH, Darmstadt, Fed. Rep. of Germany

[21] Appl. No.: 881,528

[22] Filed: Feb. 27, 1978

[30] Foreign Application Priority Data

Mar. 1, 1977 [DE] Fed. Rep. of Germany ..... 2708758

[51] Int. Cl.[2] ..... E04F 13/00

[52] U.S. Cl. ..... 52/821; 220/307; 220/352

[58] Field of Search ..... 220/DIG. 19, 352, 307; 52/624

[56] References Cited

U.S. PATENT DOCUMENTS

| | | | |
|---|---|---|---|
| 2,733,052 | 1/1956 | Luther | 220/DIG. 19 |
| 3,262,599 | 7/1966 | Muller | 220/307 |
| 3,454,186 | 7/1969 | Melone | 220/352 |
| 3,982,649 | 9/1976 | Wanderer | 220/DIG. 19 |

*Primary Examiner*—John E. Murtagh

*Attorney, Agent, or Firm*—Curtis, Morris & Safford

[57] ABSTRACT

What is disclosed is a closure for closing the edge of a webbed structure having openings formed therein, said closure comprising a strip of flexible material having a plurality of projections formed thereon in a predetermined spaced relation selected to permit insertion of said projections into at least some of said openings, at least some of said projections including means for frictionally engaging the inner surfaces of the openings into which they are inserted to hold said strip on and against the edge of the webbed structure.

2 Claims, 10 Drawing Figures

FIG. 1
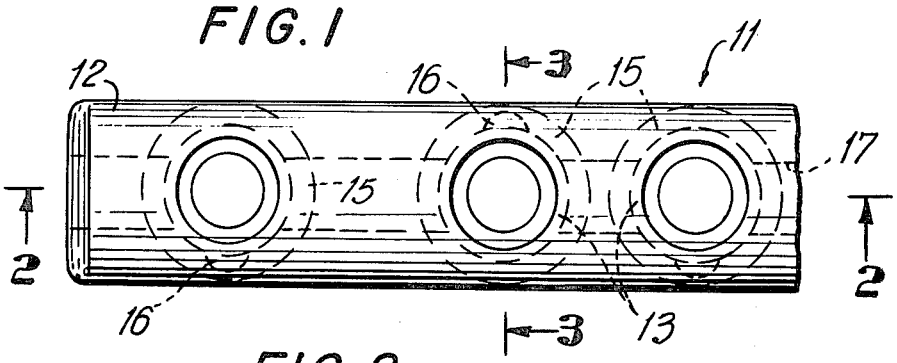
FIG. 2
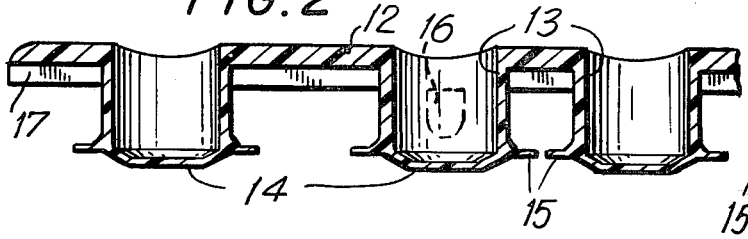
FIG. 3
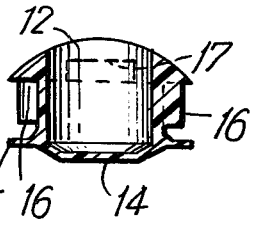
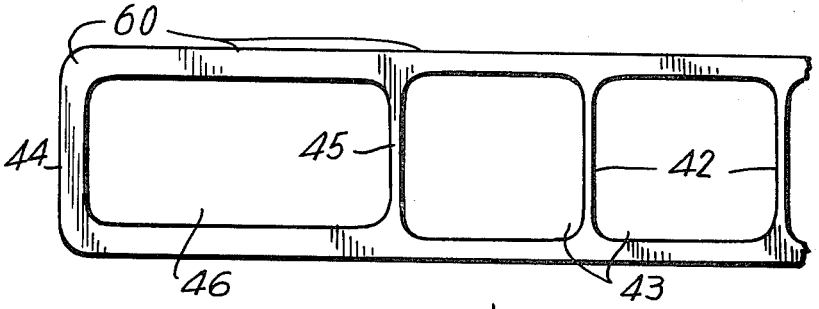
FIG. 4
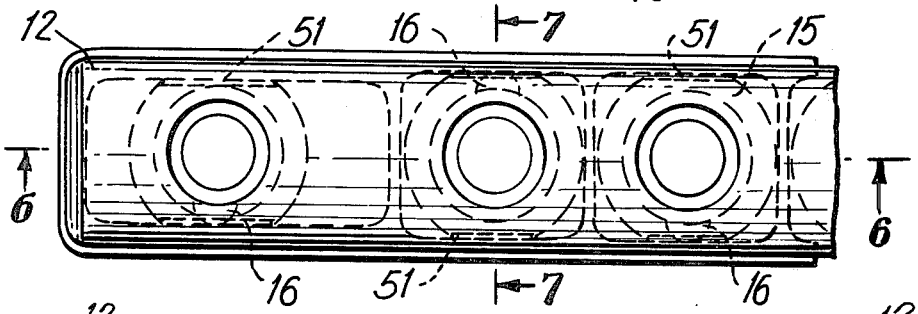
FIG. 5
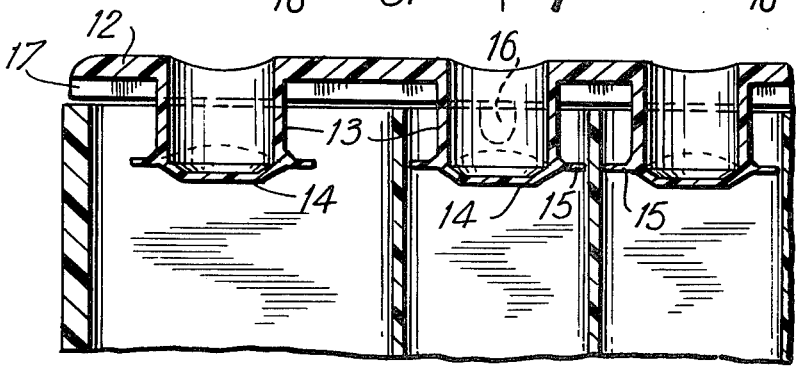
FIG. 6
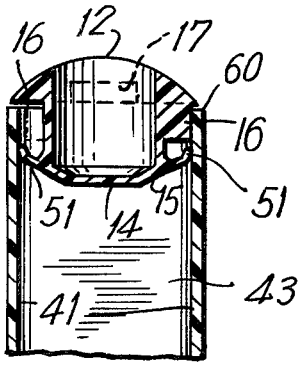
FIG. 7

FIG.8
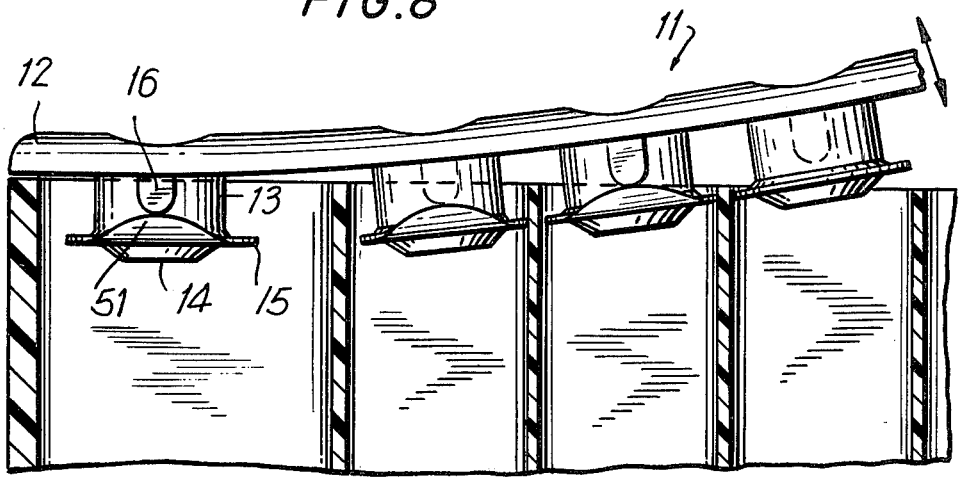
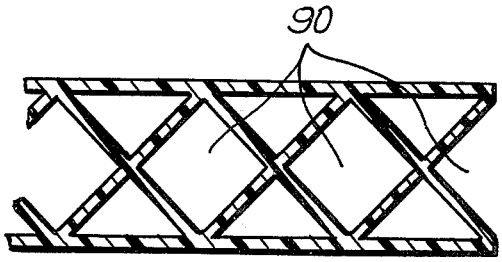
FIG.9
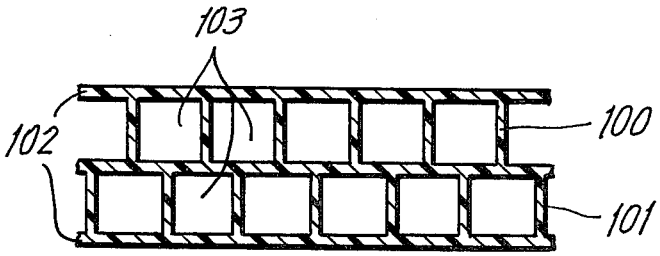
FIG.10

CLOSURE FOR DOUBLE-WALLED WEBBED STRUCTURES

CLOSURE FOR DOUBLE-WALLED WEBBED STRUCTURES

The present invention relates to a closure suitable for use with plate or sheet structures of the "sandwich" type and in particular for use with double-walled webbed structures.

The principle of the double-walled "sandwich" plate structure is variously exploited in technology. Plates constructed according to this principle and which are light-transparent are of particular interest. These plates can be described more in detail as flat, hollow, shaped structures, extruded as a strand, having two relatively thin outer walls which form the exterior surfaces of the plate and a plurality of stiffening walls therebetween, arranged to present a grillwork-like or framework-like cross section, by which the outer walls are firmly bound together.

As the light-transparent plate material, polyvinylchloride, polyethylene, polystyrene, polyamides, polyacrylates, polymethacrylates, polyformaldehyde, and polycarbonates, as well as copolymers and mixtures of polymers, can be used, for example. Such plates are extensively used in construction and lighting technology. Flat double-walled light-transparent plates having interior stiffening walls (webs) which are perpendicular to the outer walls and parallel to the edges thereof, that is so-called "double-walled webbed plates", have been particularly widely introduced in practice. This arrangement results in a considerably improved stiffness against bending and sagging and generally improved mechanical properties when compared with compact plates of the same weight. Plates of this kind are described in German Offenlegungsschrift No. 16 09 777, for example.

In the usual double-walled webbed plates, the breadth of the hollow shaped structure is generally at least one to about two powers of ten greater than the height of the shaped structure.

The webs are generally arranged at uniform intervals, with the exception of the region directly adjacent the edges. The separation between the webs is of the same order of magnitude as the height of the shaped structure.

Typical dimensions, such as are shown for example by commercially available light-transparent double-walled webbed plates are, for example, a plate breadth of 60 to 120 centimeters, a height for the hollow structure of about 1.6 to 4 centimeters, and a separation of the webs therein of about 1.6 to 4 centimeters.

The dimensions, and in particular the breadth of the plates, will be adapted to a certain type of product or end use, but can vary within certain limits. This is also true for the wall thickness of the outer walls and of the webs. Nevertheless it deserves to be kept in mind that double-walled webbed plates having wall thicknesses of little more than 1 mm already possess very satisfactory mechanical properties, in particular a high rigidity.

As to the dimensions of the double-walled webbed plate perpendicular to the direction of extrusion, the limiting size is the dimension of the extrusion nozzle of the forming apparatus. Commercially available double-walled webbed structures formed from thermoplastic synthetic resins can, for example, be prepared by means of an extrusion press injection apparatus having an exit nozzle of broad cross-section. Such an apparatus is shown and described in German Offenlegungsschrift No. 15 04 800.

In certain of the double-walled webbed plates which are commercially available, the two outer edges, which run parallel to the interior stiffening webs, are formed into a somewhat larger chamber having strengthened walls, in order in this way to protect the sensitive edges against damage. Nevertheless, the double-walled webbed plates of conventional structure have "open edges" in a direction perpendicular to the stiffening webs, either from their manufacture or from processing. When the stiffening webs are arranged in parallel between the plate walls, the open edges, viewed from above, define a plurality of adjacent cell-like cavities. The plate as a whole, with the exception of the aforementioned edge zones, thus forms a system of hollow chambers lying one next to the other.

When the double-walled webbed plates are used as light-transparent elements, for example in construction as a facade for balconies, in greenhouses, and the like, it is of some significance that they contain openings, at least on the lower edges, through which water which is condensed within the plates can escape.

It is easy to see that, for double-walled webbed plates, there is a danger of damage particularly to those places where the relatively thin-walled plates have exposed edges, i.e. on their "open edges".

Because of the danger of damage to the plates, especially to their open edges, the storage, transport, and supplying in general of double-walled webbed plates of this type is not without problems. Further, it is hard to avoid the penetration of dust or dirt into the open hollow spaces within the double-walled webbed structures. The subsequent removal of these contaminants from the chambers of the light-transparent double-walled structures is very burdensome.

It has been sought to meet these difficulties by covering the open edges of the double-walled webbed structures with an adhesive tape covering. However, this solution is not satisfactory. In particular, the removal of the adhesive tape covering proves laborious and time consuming.

It has now been found that double-walled webbed plates can be protected both against the penetration of dust and dirt and against damage if the open edges thereof are covered with a flexible, pressure-fit, closure strip.

A better understanding of the present invention and of its many advantages will be had by referring to the accompanying drawings in which FIG. 1 is a plan view of a closure strip according to the present invention;

FIG. 2 is a side sectional view of the same strip taken along line 2—2 of FIG. 1;

FIG. 3 is a sectional view of the strip of FIG. 1 taken along line 3—3 thereof;

FIG. 4 is a plan view of the "open edge" portions of a double-walled webbed structure which can advantageously be sealed using the closure strip of the invention;

FIG. 5 is a plan view showing the closure of FIG. 1 used to close the structure of FIG. 4;

FIG. 6 is a side sectional view of the arrangement of FIG. 5 taken along line 6—6 thereof;

FIG. 7 is a sectional view of the arrangement of FIG. 5 taken along line 7—7 thereof;

FIG. 8 is a side elevation showing the insertion or removal of a closure strip according to the invention into, or from, a typical double-walled webbed structure; and FIGS. 9 and 10, show two further typical embodiments by double-walled webbed structures, otherwise known in the art, which can be sealed by embodiments of the closure of the present invention.

More in particular, FIGS. 1–3 of the drawings show one embodiment of the closure of the invention. Closure 11, suitably of a material such as polyethylene, comprises flexible, but relatively heavy-gauge, continuous sealing strip 12 having hollow columnar projections 13 extending therefrom at spaced intervals. Each upwardly open projection 13 terminates in closed end portion 14 having thin-walled highly-flexible peripheral portions 15 extending outwardly beyond the dimensions of projection 13. Conveniently, but not necessarily, projections 13 are formed as right circular cylinders and closed end portions 14 are also circular, in which case portion 15 is a thin annular flange. To aid in seating and centering closure 11 within the double-walled element, projections 13 may be provided with ribs 16 which are suitably located on opposite sides of the columnar shaft of alternating projections 13. Groove 17 may be formed in the underside of strip 12 to make it more flexible, if desired.

Closure 11 of FIGS. 1–3 is of dimensions suitable for sealing the "open edge" portions of the double-walled webbed structure of FIG. 4. FIG. 4 shows the edges of spaced parallel sheets 41, suitably of a transparent or translucent material such as polymethylmethacrylate, supported by relatively thinner interior webs 42 of the same material. Sheets 41 and webs 42 extend in a dimension perpendicular to the plane of the paper to define a plurality of elongated rectangular cells 43. For strength, exterior wall 44 and last interior web 45 may be formed of thicker gauge material. End cell 46 may also be larger in one lateral dimension than remaining cells 43.

As shown in FIGS. 5, 6, 7, and 8, closure 11 is pressure-fitted into the open edge of the structure of FIG. 4 with the midpoint of each columnar projection 13 at the respective midpoint of each rectangular cell 43, 46. Because the diameter of flexible flanges 15 slightly exceeds the smallest interior dimension of rectangular cells 43, 46 (if they are not of uniform dimensions, i.e. squares), segments 51 of flanges 15 fold up against walls 41 of the cells and hold closure 11 in sealing arrangement by frictional fit. As is particularly evident from FIG. 6, ribs 16 provide a centering and guiding function, particularly when the closure is inserted. As also shown in FIGS. 5 and 7, strip 12 is of sufficient width to span walls 41, thereby sealing cells 43 from dirt and acting also to protect impact-sensitive edges 60. Strip 12 suitably has a convex cross-section, for example as shown in FIGS. 3 and 7.

Evidently, the specific dimensions of a closure 11 are chosen to be compatible with those of a particular double-walled webbed element to be sealed. Thus, closures similar to the embodiment of FIGS. 1–3 can be dimensioned to seal the double-walled webbed structure of FIG. 9, having square elongated cells 90 into which projections like projections 13 can be pressure-fitted.

Similarly, a plurality of closures like closure 11 of FIGS. 1–3 could be used separately to seal superimposed rows 100 and 101 of the structure of FIG. 10, or a wider closure bridging exterior walls 102 could be fashioned. In each case, capped protuberances would be pressure fit within all or some of rectangular (in this case square) cells 103.

The closures according to the invention are made of a flexible material which is elastic and resistant to abrasion, such as polyethylene, polyvinyl acetate, and the like. Suitably the closures should be able to be made with simple apparatus, preferably by injection molding, for example.

The closures of the invention provide temporary protection against soiling and damage during storage, during transport or by other handling. They are readily removed when no longer needed and can be discarded or reused. In certain end uses of the sealed plate structures, the closures may remain in place. They may be colorless or colored to distinguish them from the sealed plate structure. However, if the structures have transparent walls, then colorless closures, or closures of the same color as the transparent walls, are preferred to render any abrasion of the closure less evident in the interior of the sealed structure.

What is claimed is:

1. A closure closing the edge of a webbed panel structure including at least one pair of spaced parallely extending side walls and a plurality of webs extending therebetween defining a plurality of polygonal openings in the panel structure; said closure comprising a strip of flexible material whose width is substantially equal to the width of the panel edge to overlie and seal said edge, said strip having a plurality of hollow cylindrical projections formed thereon in a predetermined spaced relation along the length of the strip selected to permit insertion of said projections into at least some of said openings, said hollow projections having a first open end at the strip and an opposite closed end adapted to be inserted in said opening; at least some of said projections including integral peripheral annular flexible flange means formed on and surrounding the closed end thereof for frictionally engaging at least one of the inner surfaces of the walls and webs defining the openings in said panel structure and into which they are inserted to hold said strip on and against the edge of the webbed panel structure; each of said projections including a single longitudinal rib formed thereon and extending parallel to the central axis of the projections for guiding and positioning said projections in said openings; said ribs on adjacent projections being located on opposite sides of their respective associated projection.

2. A closure as defined in claim 1 wherein the diameter of said flanges is greater than at least one interior dimension of the openings into which they are to be inserted.

* * * * *